US005652944A

United States Patent [19]

Masuda et al.

[11] Patent Number: 5,652,944

[45] Date of Patent: Jul. 29, 1997

[54] SERIAL ELECTROPHOTOGRAPHIC APPARATUS WITH FIRST AND SECOND SUPPLY CHAMBER WITH STIRRING ARRANGEMENTS

[75] Inventors: Syuzo Masuda, Saijo; Ryouichi Iwama, Kawasaki, both of Japan

[73] Assignee: Fujitsu Limited, Kawasaki, Japan

[21] Appl. No.: 458,829

[22] Filed: Jun. 2, 1995

[30] Foreign Application Priority Data

Jul. 29, 1994 [JP] Japan ..... 6-179305

[51] Int. Cl.[6] ..... G03G 15/00; G03G 15/08

[52] U.S. Cl. ..... 399/24; 399/254; 399/262; 399/263

[58] Field of Search ..... 355/200, 260, 355/245, 210; 399/24, 110, 119, 254, 255, 258, 262, 263

[56] References Cited

U.S. PATENT DOCUMENTS 4,958,191 9/1990 Yamada et al. ..... 355/245

5,061,968 10/1991 Kita ..... 355/326

5,220,379 6/1993 Fukuchi et al. ..... 355/200

5,294,960 3/1994 Nomura et al. ..... 355/210

5,325,163 6/1994 Nishio ..... 355/260

FOREIGN PATENT DOCUMENTS 61-152463 7/1986 Japan .

*Primary Examiner*—William J. Royer

*Attorney, Agent, or Firm*—Armstrong, Westerman, Hattori, McLeland & Naughton

[57] ABSTRACT

A processing part mounted in a carriage for effecting printing when translated in a direction perpendicular to a direction in which recording paper is transported includes a developing unit, the developing unit including a toner chamber and a toner cartridge detachably coupled to the toner chamber.

7 Claims, 13 Drawing Sheets

58c

START OF PRINTING
58c
55
71
STATIONARY 58c
55
71
ACCELERATED 58c
55
71
CONSTANT SPEED

END OF PRINTING
58c
55
71
DECELERATED 58c
55
71
STATIONARY
RETURN 58c
55
71
ACCELERATED 58c
55
71
CONSTANT SPEED 58c
55
71
DECELERATED 58c
55
71
STATIONARY
STAND-BY POSITION

SERIAL ELECTROPHOTOGRAPHIC APPARATUS WITH FIRST AND SECOND SUPPLY CHAMBER WITH STIRRING ARRANGEMENTS

BACKGROUND OF THE INVENTION

1. Field of the Invention

The present invention relates to serial electrophotographic apparatuses, and more particularly to a serial electrophotographic apparatus in which a latent image is formed on a recording drum, and toner is used to print a visible image on recording paper.

A demand for inexpensive and compact electrophotographic apparatuses has resulted in the development of serial electrophotographic printers. In electrophotographic printers, a carriage for carrying a printhead is capable of performing an electrophotographic process. In these electrophotographic printers, recording paper is transported on a transferring unit in a direction perpendicular to a direction in which the carriage is translated so that the transferring unit effects an image transfer onto the recording paper. A roller-shaped fixing unit disposed ahead of the carriage in the direction of transportation effects fixing. In serial electrophotographic printers, improvement in printing quality is requested.

2. Description of the Prior Art

FIGS. 1A and 1B show a constitution of a conventional serial electrophotographic printer 11, FIG. 1A being a partial top view of the printer, and FIG. 1B being a cross-sectional view of a carriage.

The serial electrophotographic printer 11 shown in FIGS. 1A and 1B is disclosed in Japanese Laid-Open Patent Application Ser. No. 61-152463. In the electrophotographic printer 11, a shaft 14 is disposed parallel with rollers 13*a* and 13*b* for transporting recording paper 12. A carriage 15 is driven by a motor (not shown) and guided by the shaft 14 to be movable in a direction perpendicular to a direction in which the recording paper is transported. A fixing unit 16 longer than the width of the recording paper 12 is fixed ahead of the carriage 15 in the direction in which the recording paper is transported. A transferring unit 17 is disposed below the recording paper 12 to lie in the direction in which the carriage 15 is transported.

The carriage 15 carries an image carrying body (recording drum) 21 which is rotated at a peripheral speed synchronized with the movement of the carriage 15. The surface of the image carrying body 21 is uniformly charged by a charger (a charging roller) 22, and an electrostatic latent image is formed by an exposer 23. The electrostatic latent image is made visible to become a toner image by a developing roller 26 which is formed adjacent to the image carrying body 21 and supplies toner 25 stored in a developing unit 24 to the image carrying body 21. The toner image formed on the image carrying body 21 is transferred to the recording paper 12 by the transferring unit 17 disposed opposite to the image carrying body 21, the recording paper 12 being led through a space between the image carrying body 21 and the transferring unit 17. The recording paper 12 is transported so that a part which has undergone a transferring process faces the fixing unit 16, whereupon the image is fixed.

The toner 25 is formed, for example, by mixing iron powder with plastic powder having a softening point (melting point) of 100°–150° C. and a diameter of 10–50 μm and painted in a predetermined color. When left in an unchanged condition for a extended period of time, some powders become glued to each other. Hence, it is necessary to shake or stir the toner when it is used.

If the developing unit 24 is filled with the toner 25, it is possible for the developing roller 26 to supply the toner 25 to the recording drum 21 in a stable manner. However, the aforementioned property of the toner 25 may turn the toner 25 into lumps within the developing unit 24 when the quantity of the toner 25 decreases and may invite a problem in that it is impossible to supply the toner 25 to the recording drum 21 in a stable manner, and thus deteriorating printing quality.

SUMMARY OF THE INVENTION

Accordingly, a general object of the present invention is to provide a serial electrophotographic apparatus in which the aforementioned problem is eliminated.

A more specific object of the present invention is to provide a serial electrophotographic apparatus in which toner is supplied in a stable manner, and printing quality is improved.

The aforementioned objects of the present invention can be achieved by a serial electrophotographic apparatus comprising: transporting means for transporting recording paper; a carriage equipped, at least, with processing means for exposing a rotated image carrying body, forming a latent image by charging the image carrying body, and developing the latent image to produce a visible image by supplying a print substance from a developing part to the image carrying body, the processing means including a first supply chamber for supplying the print substance to the developing part and a second supply chamber detachably coupled to the first supply chamber; transferring means which, provided in such a position that the recording paper is led through a space between the carriage and the transferring means, transfers the visible image onto the recording paper as the carriage is being translated; and translating means for translating the carriage over the transferring means, in a direction perpendicular to a direction in which the recording paper is transported. According to the serial electrophotographic apparatus of the present invention, a developing unit for supplying a print substance to an image carrying body is composed of a first supply chamber and a second supply chamber detachably coupled to the first supply chamber. In this way, supplying of the print substance is facilitated. Specifically, it is possible to stabilize supply of the print substance stored in the first supply chamber. Hence, improper supplying is prevented, and printing quality can be improved.

In a preferred embodiment, first stirring means for stirring the print substance is provided in the second supply chamber. Desirably, the second supply chamber is provided with a first transmitting part to which a driving force for driving the first stirring means is transmitted from the first supply chamber. According to this aspect of the present invention, it is possible to supply the print substance from a supply outlet of the second supply chamber to the first supply chamber in a stable manner.

In another preferred embodiment, the second supply chamber is provided with second stirring means which, swung in response to translation of the carriage, stirs the print substance in the second supply chamber. Desirably, operating means for swinging the stirring means is provided outside the second supply chamber, and engagement means which, engaged with the operating means, swings the operating means is provided at a predetermined position along a path of the carriage. According to this aspect of the present invention, the second stirring means stirs the print substance each time the carriage reciprocates so as to supply the print substance in a stable manner. Consequently, supply of the print substance is facilitated. Specifically, it is possible to stabilize the supply of the print substance from the first supply chamber. Hence, printing quality is improved.

In still another preferred embodiment, the second supply chamber is provided with third stirring means for stirring the print substance in the second supply chamber by swinging in response to translation of the carriage in a direction in which the carriage is translated. According to this aspect of the present invention, third stirring means provided in the second supply chamber stirs the print substance by swinging in response to the translation of the carriage, in a direction in which the carriage is translated. In this way, the supply of the print substance is facilitated. Specifically, it is possible to stabilize the supply of the print substance from the first supply chamber. Hence, printing quality is improved.

In yet another preferred embodiment of the present invention, the first supply chamber is provided with fourth stirring means which stirs, in response to translation of the carriage, the print substance in the first supply chamber by swinging in response to translation of the carriage. According to this aspect of the present invention, the supply of the print substance from the second supply chamber is facilitated so that it is possible to stabilize the supply of the print substance from the first supply chamber. Hence, printing quality is improved.

In yet another preferred embodiment, the first supply chamber is provided with fifth stirring means for stirring the print substance in the first supply chamber by swinging in response to translation of the carriage in a direction in which the carriage is translated. According to this aspect of the present invention, the supply of the print substance from the second supply chamber is facilitated so that it is possible to stabilize the supply of the print substance from the first supply chamber. Hence, printing quality is improved.

In yet another preferred embodiment, a shield part having a restitutive capability is provided at an outlet of the second supply chamber via which outlet the print substance is supplied to the first supply chamber, so as to open and to seal by closing the outlet, and wherein an inserted part is provided in the first supply chamber and allowed to enter the second supply chamber through the shield part so as to establish communication between the first supply chamber and the second supply chamber. Desirably, a notch for allowing the inserted part to enter the second chamber is formed in the shield part. According to this aspect of the present invention, splash contamination by the print substance as a result of the attaching or detaching of the second supply chamber is prevented. Hence, printing quality is improved.

In still another preferred embodiment of the present invention, the outlet provided in the second supply chamber to supply the print substance to the first supply chamber is formed to have a taper having a predetermined gradient. According to this aspect of the present invention, it is possible to stabilize the supply of the print substance from the second supply chamber to the first supply chamber.

BRIEF DESCRIPTION OF THE DRAWINGS

Other objects and further features of the present invention will be apparent from the following detailed description when read in conjunction with the accompanying drawings, in which.

DESCRIPTION OF THE PREFERRED EMBODIMENTS

Figure 1A:
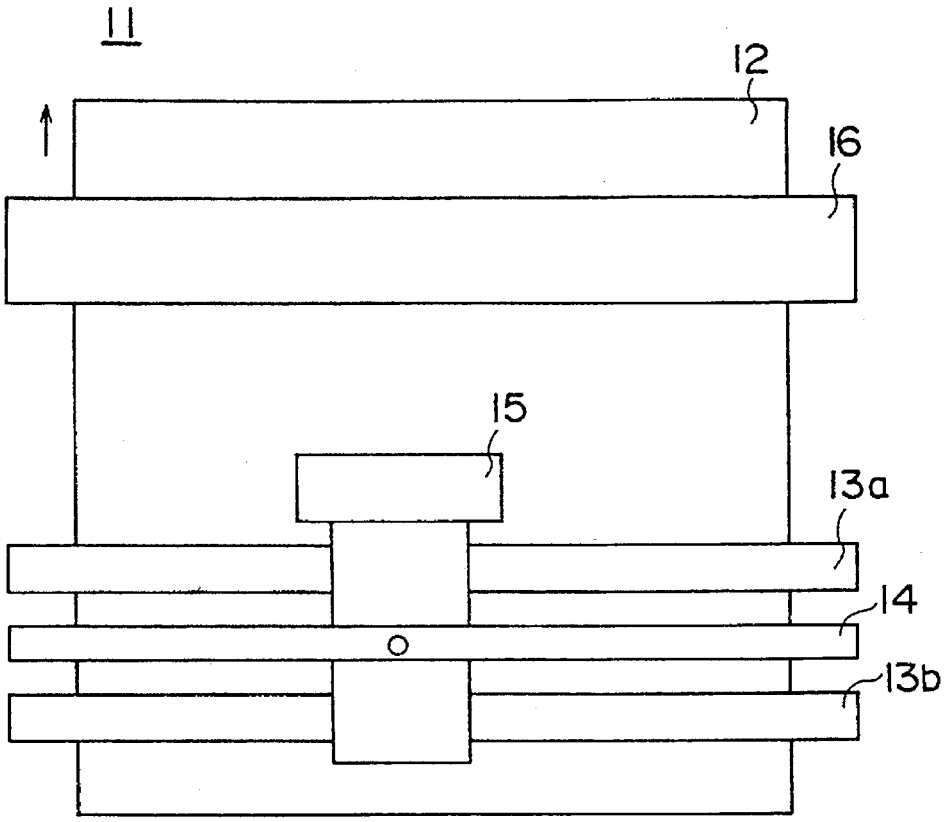
FIG. 1A PRIOR ART
FIGS. 1A and 1B show a constitution of a conventional serial electrophotographic printer.
Figure 1B:
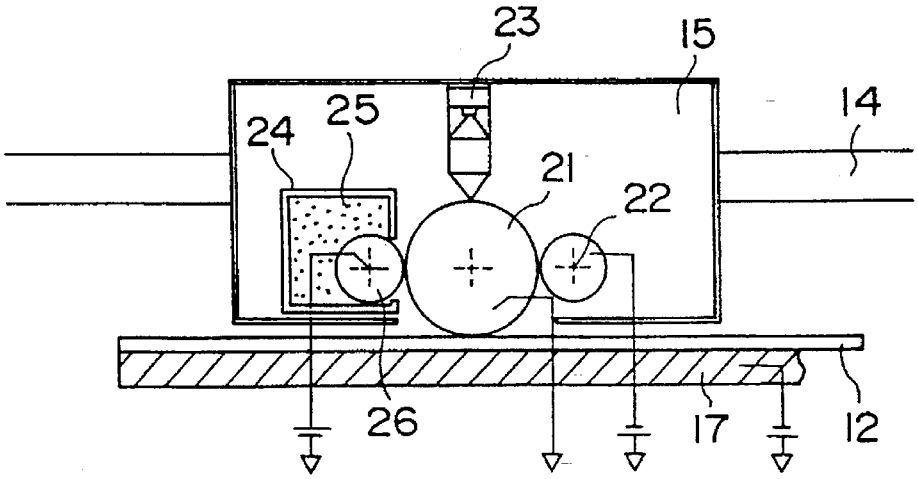
FIG. 1B PRIOR ART
Figure 2A:
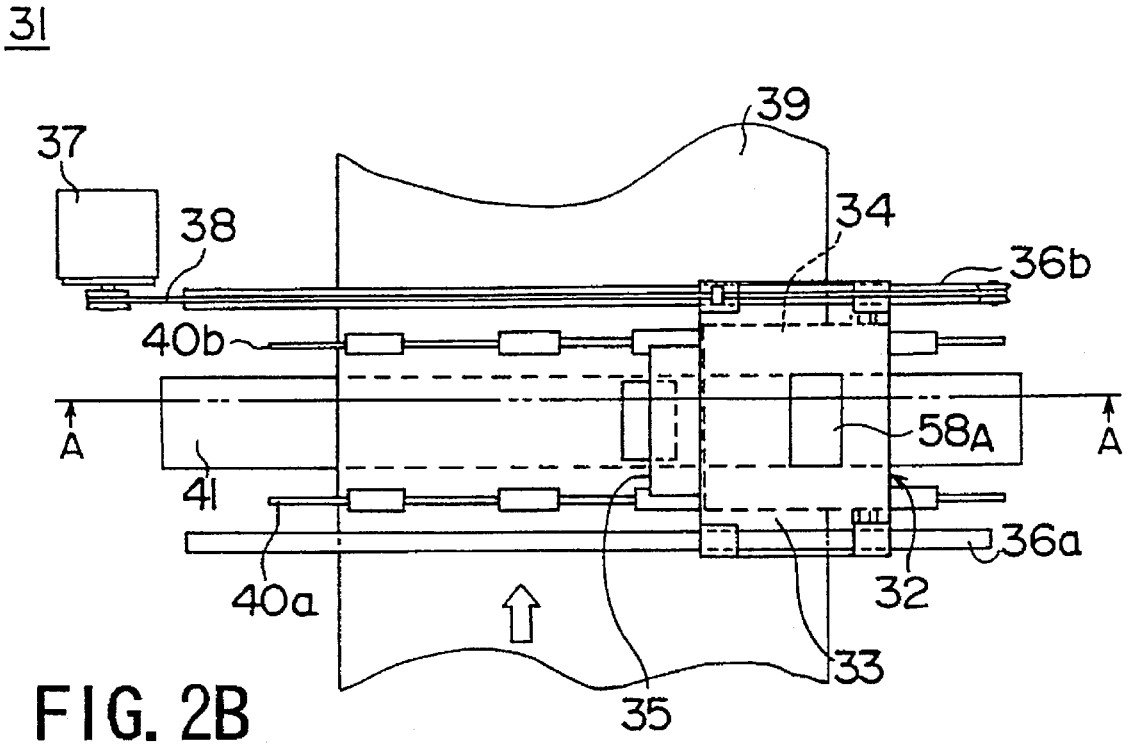
FIGS. 2A and 2B show a constitution of a first embodiment of the present invention.
Figure 2B:
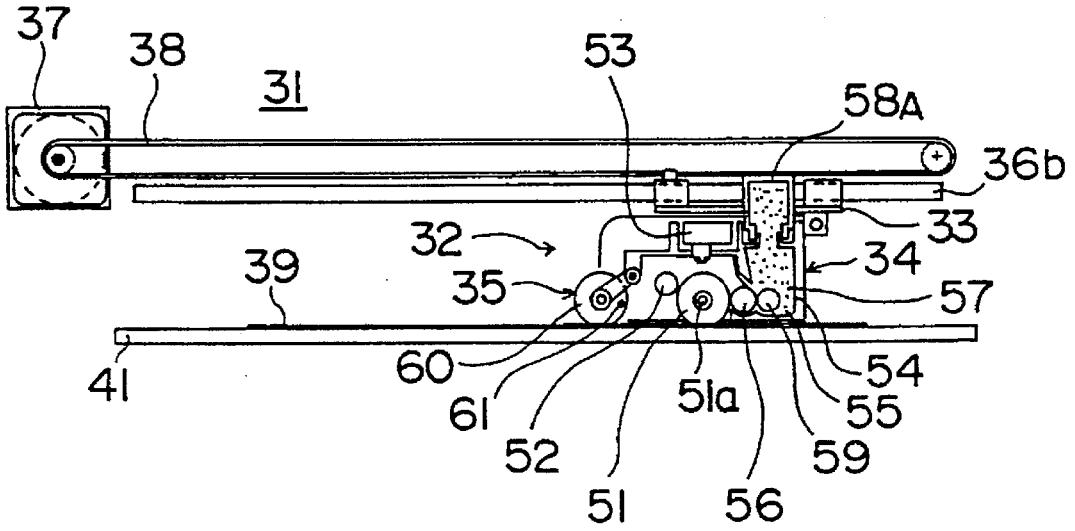

FIGS. 2A and 2B show a constitution of a first embodiment of the present invention. FIG. 2A is a top view, and FIG. 2B is a cross-sectional view taken along the line A—A of FIG. 2A.

FIGS. 2A and 2B show a serial electrophotographic printer 31 as a specific example of an electrophotographic apparatus. A carriage 32 is constructed such that a processing part (processing means) 34 and a fixing part (fixing means) 35 are mounted to a sliding part 33.

The sliding part 33 is guided by guide shafts 36*a* and 36*b* and driven by a carrier motor (translating means) 37 via a belt 38 so as to move in a direction perpendicular to a direction in which recording paper 39 is transported. The recording paper 39 is transported in a direction indicated by an arrow by means of rotating shafts (transporting means) 40*a* and 40*b* (a driving motor for driving the rotating shafts is omitted from the illustration).

A transferring unit (transferring platen) (transferring means) 41 is disposed beneath the carriage 32 to lie in the direction in which the carriage 32 is translated. The transferring unit 41 is produced such that a heat-resistant conductive member (for example, a silicone rubber having a conductive material mixed therein) is formed on a substrate made, for example, of an aluminum, so as to face the carriage 32. The recording paper 39 is transported through a space between the transferring unit 41 and the carriage 32.

The processing part 34 of the carriage 32 has a recording drum (image carrying body) 51 built therein, the drum 51 having a rotation axis 51*a* extending parallel to the direction in which the recording paper 39 is transported and being rotated on the recording paper 39 lying on the transferring unit 41 at a peripheral speed synchronized with the translation of the carriage 32.

The surface of the recording drum 51 is uniformly charged by a charger 52, and has an electrostatic latent image formed on its surface by an exposer (LED) 53 disposed above the recording drum 51. The electrostatic latent image is turned into a toner image (visible image) by toner 55 being applied by a developing roller 56 to the recording drum 51, the toner 55 being stored in a developing unit 54. The toner image formed on the recording drum 51 is transferred to the recording paper 39 by applying a predetermined voltage between the recording drum 51 and the transferring unit 41 that sandwich the recording paper 39. The developing roller 56 is made to rotate in synchronism with the rotation of the recording drum 51 (see FIG. 4).

The developing unit 54 is composed of a first toner chamber (first supply chamber) 57 and a toner cartridge (second supply chamber) $58_A$ detachably coupled to the toner chamber 57. The toner chamber 57 is equipped with a developing roller 56 and a supply roller 59 which is in contact with the developing roller 56 to supply the toner thereto (described in detail with reference to FIG. 3).

The fixing part 35 mounted in the carriage 32 together with the processing part 34 is equipped with a fixing roller 60. The fixing roller 60 has, for example, a halogen lamp mounted therein as a heat source. A thermistor 61 is provided as a temperature detector in the fixing roller 60 so as to control the fixing roller 60 at a predetermined temperature.

Figure 3:
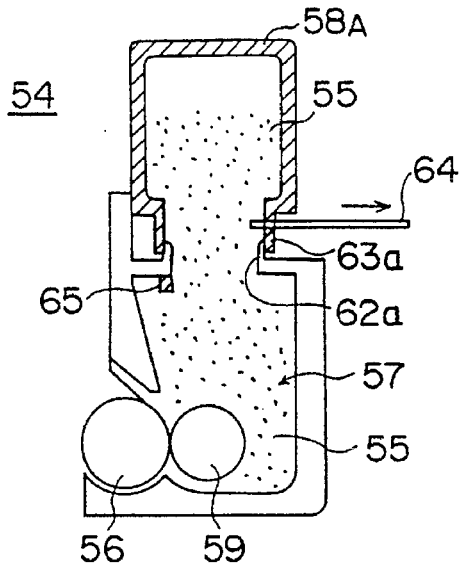
FIG. 3 is a cross-sectional view showing how a toner cartridge of FIGS. 2A and 2B is mounted in a developing unit.

FIG. 3 is a cross-sectional view showing how the toner cartridge 58A of FIGS. 2A and 2B is mounted in the developing unit 54. FIG. 3 is a cross-sectional view of the developing unit 54 showing an opening 62*a* for mounting the toner cartridge $58_A$ to the toner chamber 57.

A wide supply outlet 63*a* is formed in the toner cartridge $58_A$, and a lid 64 is provided in the supply outlet 63*a*. The lid 64 can be slid to be removed from the toner cartridge $58_A$.

The toner cartridge $58_A$ is set such that the supply outlet 63*a* of the toner cartridge $58_A$ is fitted to the opening 62*a* of the toner chamber 57. Thereafter, the toner 55 in the toner cartridge $58_A$ is supplied to the toner chamber 57 by sliding the lid 64 to be removed from the toner cartridge $58_A$.

A toner detection sensor 65 for indicating a timing at which the toner cartridge 58A should be exchanged is provided in the neighborhood of the opening 62*a* of the toner chamber 57.

Because the toner cartridge $58_A$ is detachably coupled to the toner chamber 57 in the developing unit 54, the supply of the toner is facilitated, and printing in large quantity is enabled. By detecting the timing at which the toner cartridge $58_A$ should be exchanged using the toner detection sensor 65, it is ensured that the quantity of the toner 55 within the toner chamber 57 is maintained at a certain level. Thus, the insufficient supply of the toner 55 is prevented, and printing quality is improved.

Figure 4:
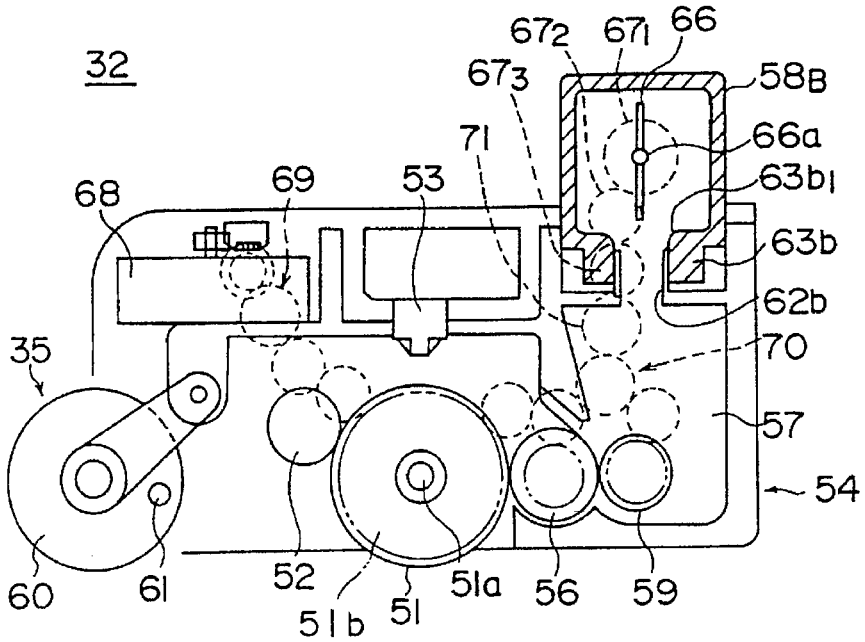
FIG. 4 is a cross-sectional view showing a constitution of a second embodiment.

FIG. 4 is a cross-sectional view showing a second embodiment of the present invention. FIG. 4 is a cross-sectional view showing a construction of the carriage 32, wherein a toner cartridge $58_B$ having a relatively narrow supply outlet 63*b* is detachably fitted to an opening (nozzle) 62*b* (narrower than the opening 62*a*) of the toner chamber 57 of the developing unit 54. A tapered portion $63b_1$ having a predetermined gradient (which may be equal to or smaller than 45 degrees) is formed in the inner wall of the supply outlet 63*b* for the purpose of facilitating the supply of the toner.

A rotatable paddle (first stirring means) 66 is provided in the toner cartridge $58_B$. Gears $67_1$–$67_3$ in meshing engagement with each other constituting a first transmitting part is coupled to a rotation axis 66*a* of the paddle 66, the rotation axis 66*a* being allowed to extend outside.

Although omitted from the illustration of the first embodiment, a process motor 68 for rotating the recording drum 51 is mounted in the carriage 32. A transmitting part 69 composed of a predetermined number of gears in meshing engagement with a drum gear 51*b* of the recording drum 51 transmits a rotation force from a rotation axis of the process motor 68 to the recording drum 51.

The drum gear 51*b* causes the developing roller 56 and the supply roller 59 to rotate via a transmitting part 70 composed of four gears. A gear 70*a* is in meshing engagement with the second transmitting part 70. When the toner cartridge $58_B$ is set, the gear 70*a* comes into meshing engagement with the gear $67_3$.

That is, when the toner cartridge $58_B$ is set, the paddle 66 within the toner cartridge $58_B$ is rotated in response to the rotation of the recording drum 51 which is rotated in synchronism with the translation of the carriage 32. In this way, the toner 55 is stirred.

As described above, the second embodiment is constituted such that the supply outlet 63*b* of the toner cartridge $58_B$ is set to be narrow, and the toner supply is conducted in a stable manner by the rotation of the paddle 66.

Figure 5:
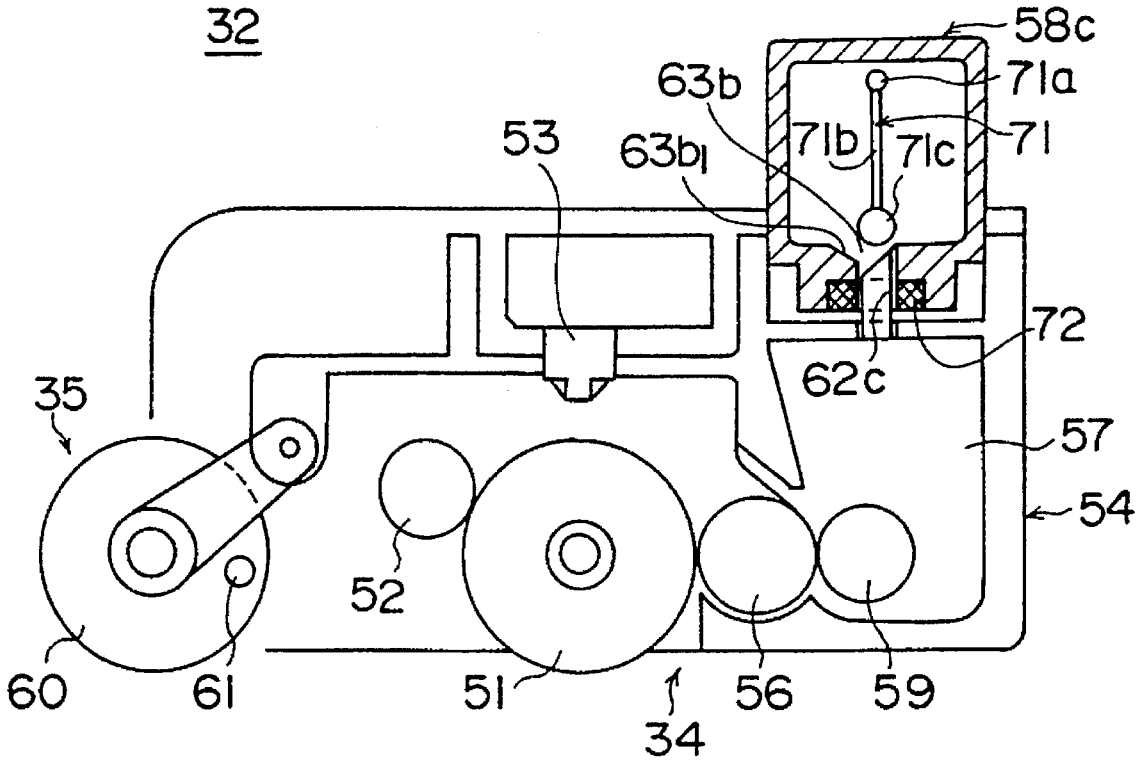
FIG. 5 is a cross-sectional view showing a constitution of a third embodiment.
Figure 6A:
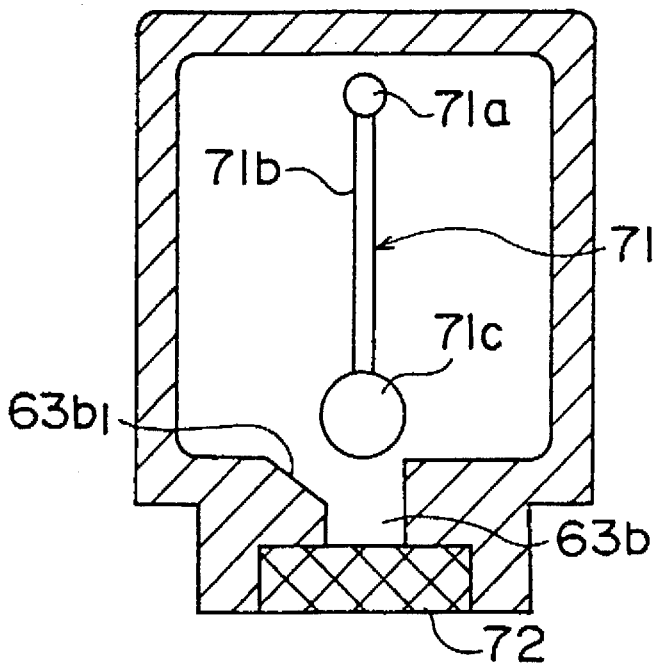
FIGS. 6A and 6B show a constitution of a toner cartridge of FIG. 5.
Figure 6B:
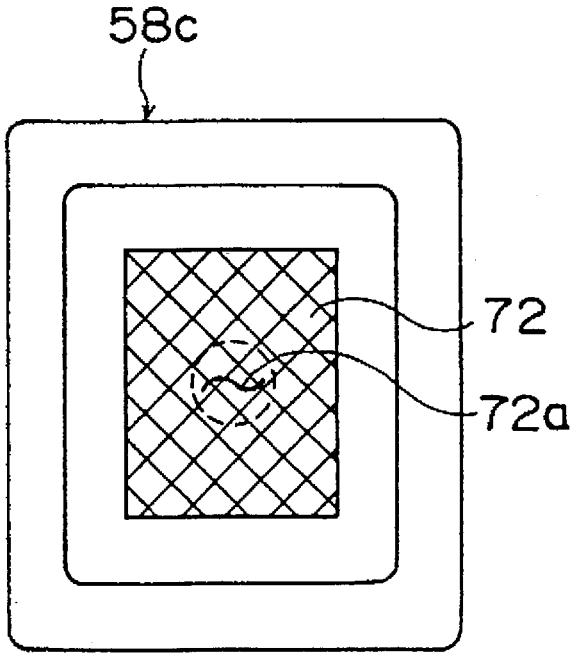

FIG. 5 is a cross-sectional view showing a constitution of a third embodiment, and FIGS. 6A and 6B show a constitution of a toner cartridge of FIG. 5. FIG. 5 is a cross-sectional view showing a construction of the carriage 32. As shown in FIGS. 5, 6A and 6B, a swinging part 71 (second stirring means) is rotatably provided in a toner cartridge $58_C$. The swinging part 71 is constructed such that a weight 71*c* is provided at the end of a rod 71*b* connected to a fulcrum shaft 71*a*. The weight 71*c* of the swinging part 71 swings in the toner cartridge $58_C$ like a pendulum in response to an external force.

The supply outlet 63*b* (a tapered part $63b_1$ having a gradient equal to or smaller than 45 degrees is formed in the inner wall thereof) of the toner cartridge $58_C$ is provided with a seal member 72. A notch 72*a* is formed in the seal member 72. Even when the supply outlet 63*b* opens at the notch 72*a* by an external force, the notch 72*a* is hermetically closed in the absence of the external force. The seal member 72 is formed, for example, of CR (chloroprene), silicone rubber or a natural rubber to have a thickness of about 3 mm. It is to be noted that the notch 72 is not indispensable.

The toner chamber 57 is provided with a nozzle 62*c* (inserted part). The toner cartridge $58_C$ is set such that the seal member 72 of the toner cartridge $58_C$ is fitted over the nozzle 62*c*. For example, the nozzle 62*c* is formed to have an outer diameter of 7 mm and an inner diameter of 6 mm.

Figure 7A:
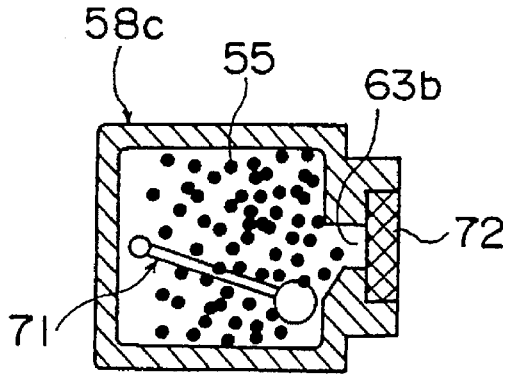
FIGS. 7A, 7B and 7C explain an operation conducted when the toner cartridge is set.
Figure 7B:
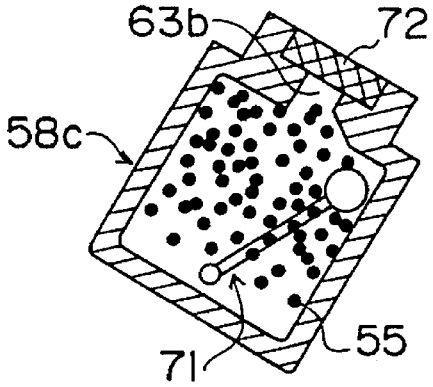
Figure 7C:
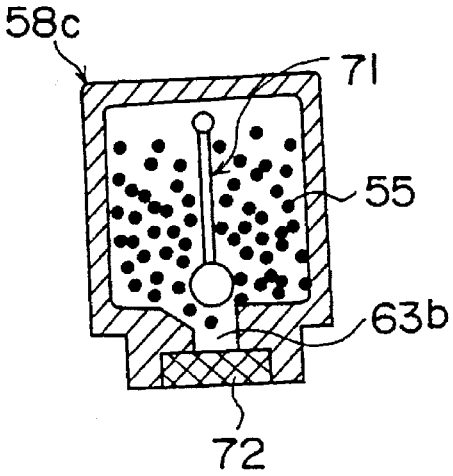
Figure 8:
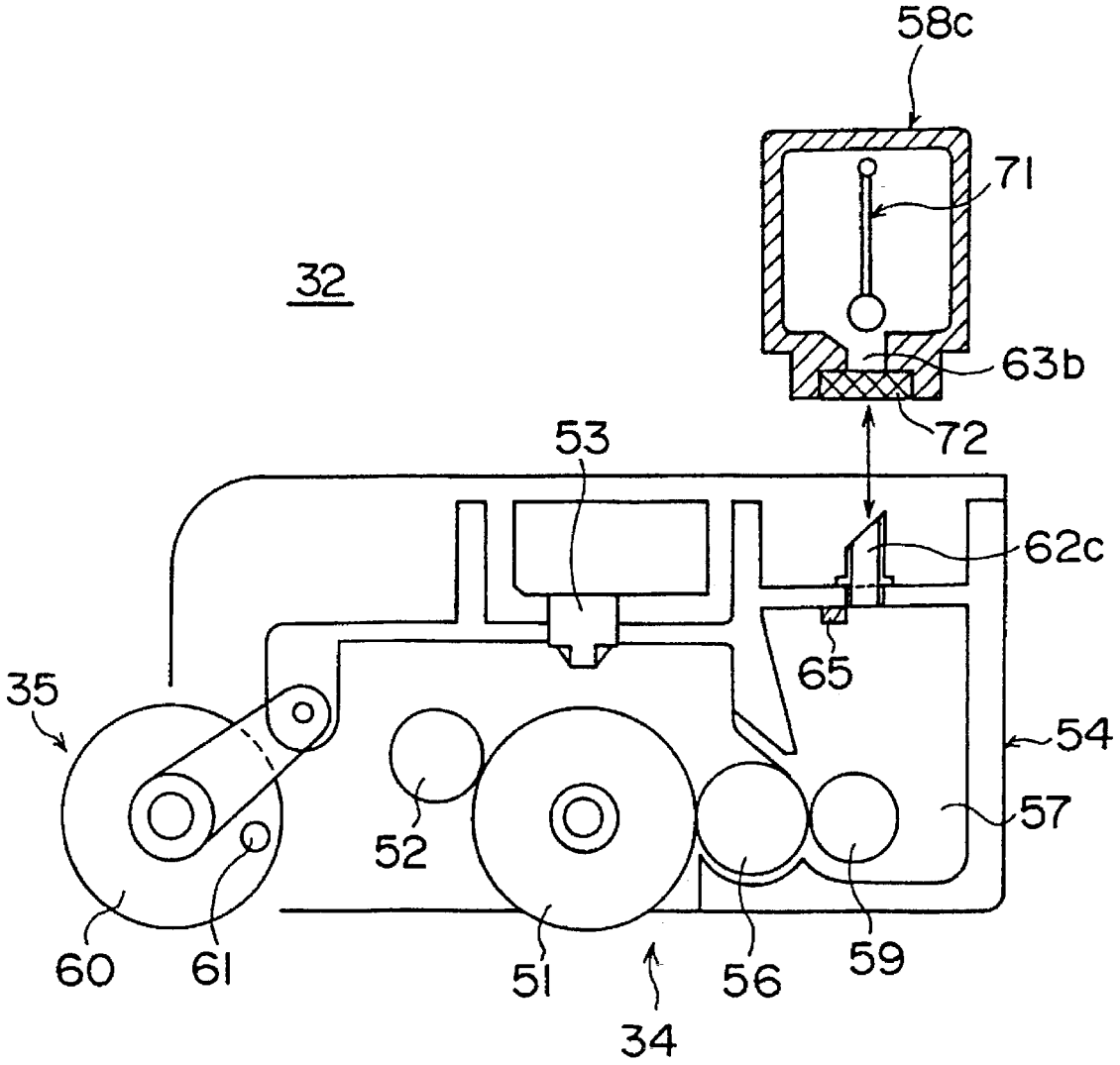
FIG. 8 shows how the toner cartridge is attached to and detached from the developing unit.

FIGS. 7A–7C explain an operation conducted when the toner cartridge 58*c* is set in the developing unit 54. FIG. 8 shows how the toner cartridge 58*c* is attached to and detached from the developing unit 54. When the toner cartridge $58_C$ is set in the developing unit 54, an operator performs a topping operation. The toner cartridge $58_C$ is then shaken so that the swinging part 71 is swung as shown in FIGS. 7A–7C, thus effecting an initial stirring of the toner 55. As shown in FIG. 8, the toner cartridge $58_C$ is set by imposing the seal member 72 on the nozzle 62*c* of the toner chamber 57 so as to be coupled to the nozzle 62*c*.

The seal member 72 acts to prevent the toner from leaking, thus preventing contamination from occurring.

In detaching the toner cartridge $58_C$, the seal member 72 wipes the toner 55 attached around the nozzle 62*c*, thus preventing contamination of the neighborhood of the nozzle 62*c* from occurring.

It is necessary to stir the toner 55 periodically after the toner cartridge $58_C$ is set in the toner chamber 57.

Figure 9A:
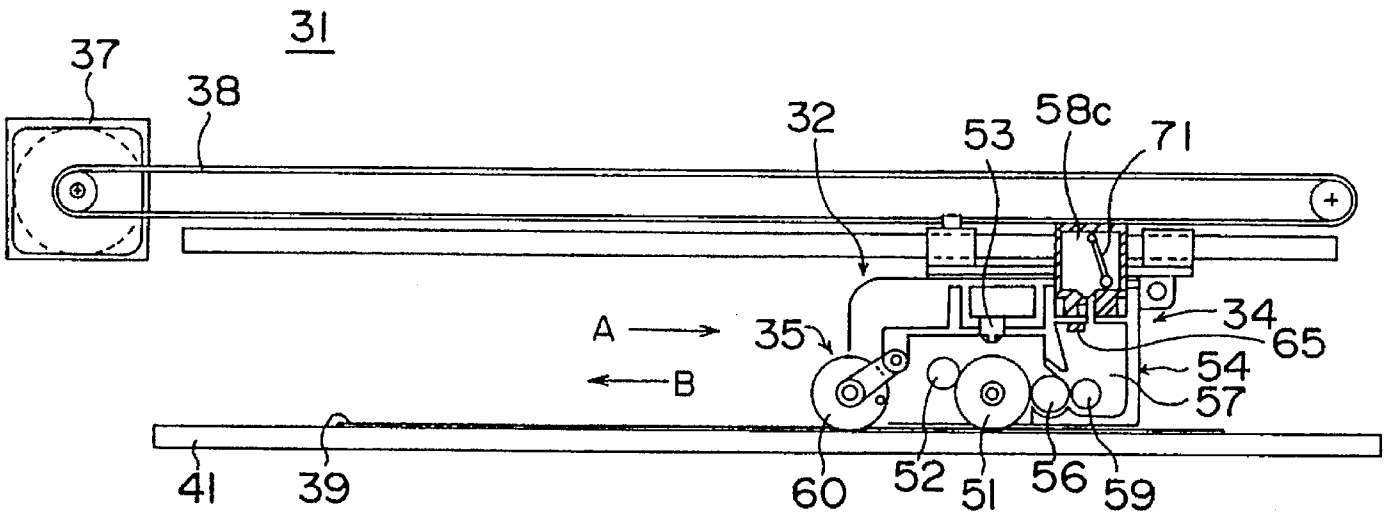
FIGS. 9A and 9B explain an operation of a third embodiment.
Figure 9B:
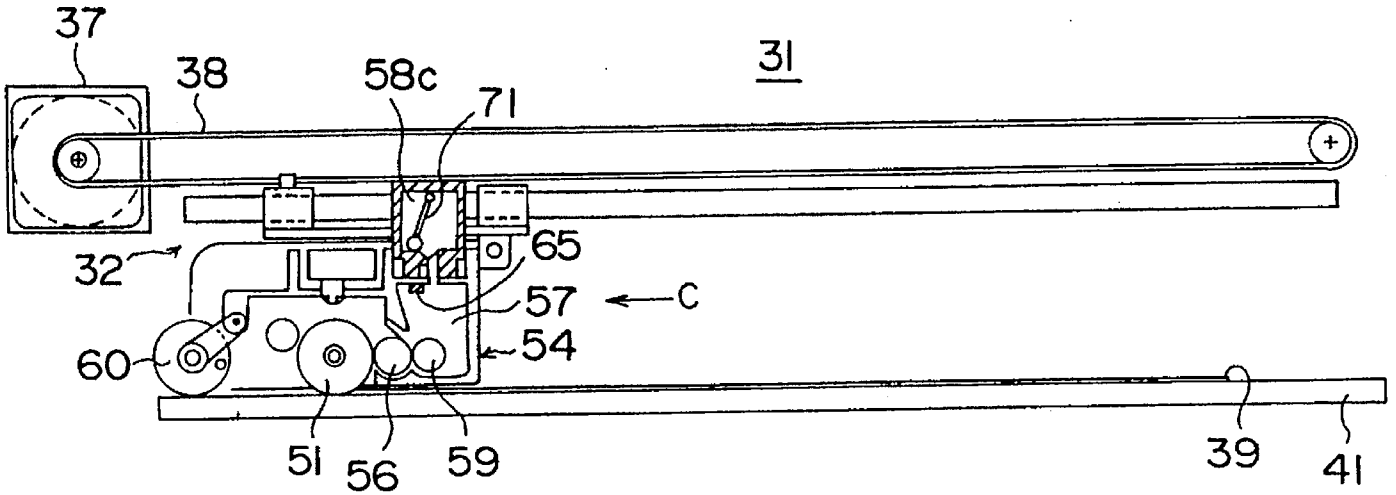
Figures 10A, 10B, 10C, 10D, 10E, 10F, 10G, 10H, 10I:
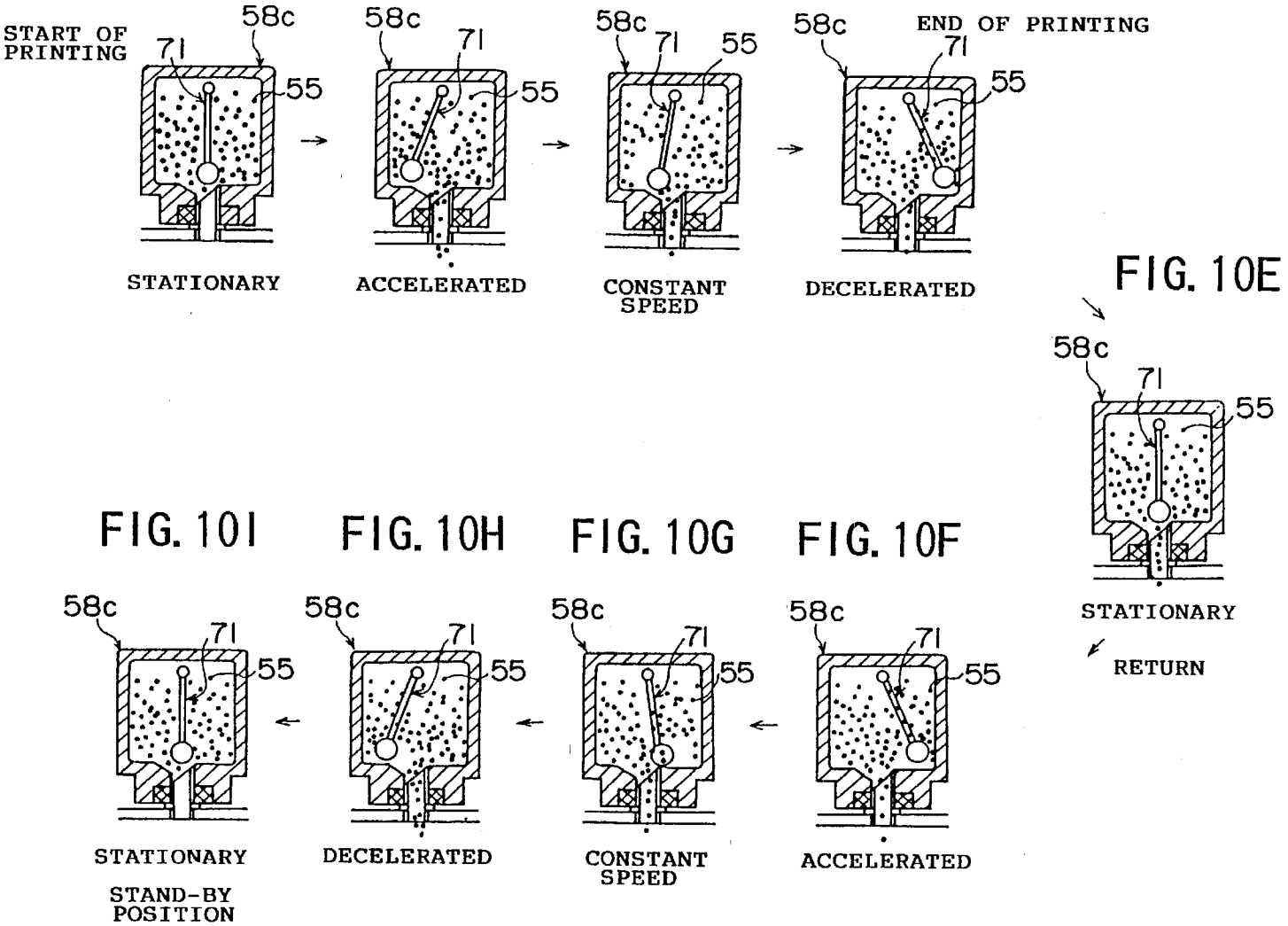
FIGS. 10A–10I explain a stirring operation within the toner cartridge in response to the translation of a carriage.

FIGS. 9A and 9B explain an operation of the third embodiment. FIGS. 10A–10I explain a stirring operation within the cartridge in response to the translation of the carriage. Referring to FIGS. 9A and 9B, and FIGS. 10A–10I, when the carriage 32 is stationary at a print start position, the swinging part 71 is suspended in a vertical position (FIG. 10A). While the carriage 32 is being accelerated, the swinging part 71 swings significantly to the left in the illustration so as to stir the toner 55 stored in one side (FIG. 10B).

When the carriage 32 reaches a constant speed, the swinging part 71 remains in a posture slightly inclined to the left (FIG. 10C). When the carriage 32 approaches a print end position, the carriage 32 is decelerated. While the carriage 32 is being decelerated, the swinging part 71 swings to the right significantly so as to stir the toner 55 stored in the other side (FIG. 10D) (assume that the carriage 32 of FIG. 9A is moving in a direction indicated by an arrow A).

When the carriage 32 becomes stationary after the printing is completed, the swinging part 71 is suspended in a vertical position (FIG. 10E).

While the carriage 32 is returning toward the print start position (home position), the swinging part 71 swings to the right significantly due to acceleration, thus stirring the toner 55 (FIG. 10F) (assume that the carriage 32 of FIG. 9A is moving in a direction indicated by an arrow B). When the carriage 32 reaches a constant speed, the swinging part 71 remains in a posture slightly inclined to the right (FIG. 10G).

While the carriage 32 is approaching the print end position and is being decelerated, the swinging part 71 swings to the left significantly so as to stir the toner 55 (FIG. 10H) (assume that the carriage 32 of FIG. 9B is moving in a direction indicated by an arrow C). When the carriage 32 returns to the home position and comes to a halt, the swinging part 71 is suspended in a vertical position (FIG. 10I).

As has been described, each time the carriage 32 makes a reciprocating motion, the swinging part 71 goes through one cycle of swinging so as to stir the toner 55. According to this embodiment, even if the tapered part $63b_1$, shown in FIG. 6A, of the supply outlet 63*b* of the toner cartridge $58_C$ has a gradient smaller than 45 degrees, the toner 55 does not turn into lumps and can be supplied in a stable manner.

When the toner 55 in the toner cartridge $58_C$ runs out, the toner detection sensor 65 in the toner chamber 57 provides an associated indication. By exchanging the toner cartridge $58_C$ so as to maintain the toner chamber 57 filled with the toner 55, the insufficient supply of the toner 55 is prevented, and printing quality is improved.

Figure 11A:
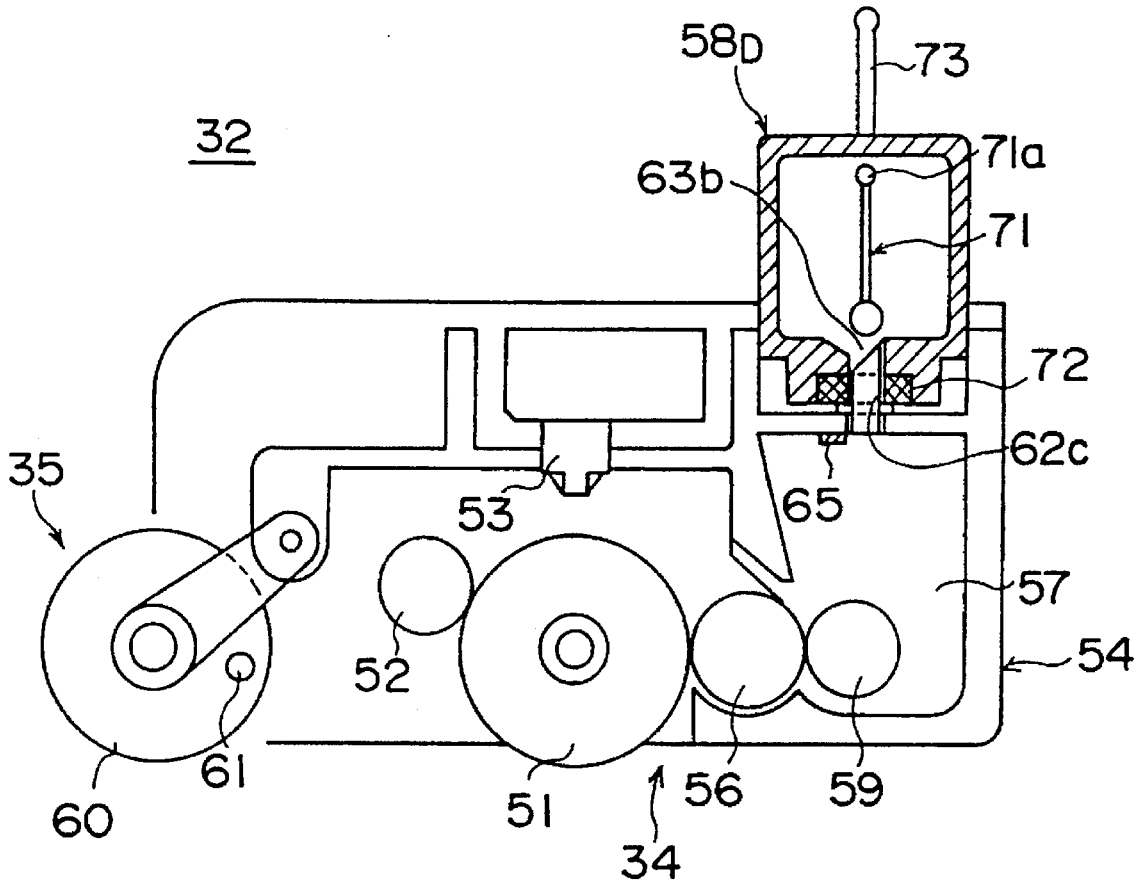
FIGS. 11A and 11B show a constitution of a fourth embodiment of the present invention.
Figure 11B:
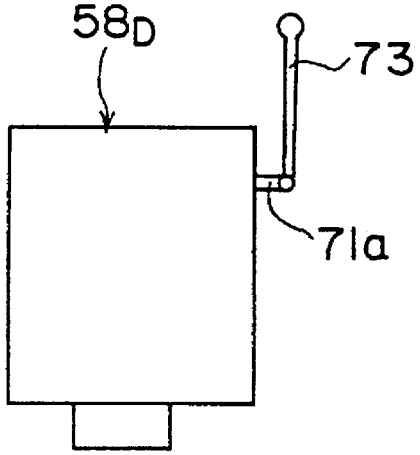

FIGS. 11A and 11B show a constitution of a fourth embodiment of the present invention. In a cartridge $58_D$ shown in FIGS. 11A and 11B, the fulcrum shaft 71*a* for supporting the swinging part 71 is allowed to extend outside, and a lever 73 is coupled to the fulcrum shaft 71*a*. The other aspects of the construction remain the same as those of the third embodiment.

By swinging the lever 73, the swinging part 71 is swung like a pendulum.

Figure 12:
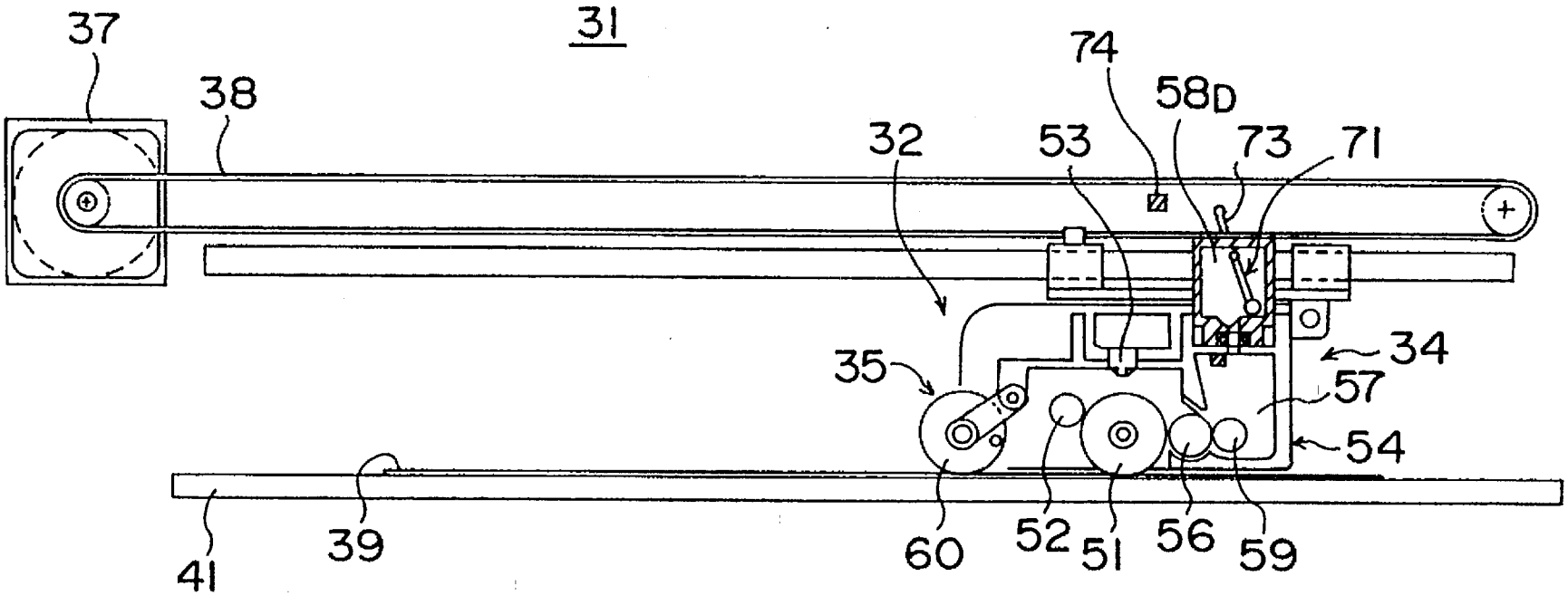
FIG. 12 explains a stirring operation of the fourth embodiment.

FIG. 12 explains a stirring operation of the fourth embodiment. The serial electrophotographic printer 31 shown in FIG. 12 is provided with an engagement part 74 which comes into engagement with the lever 73 so as to swing the lever 73 as the carriage 32 is being translated.

Each time the carriage 32 is translated so that the lever 73 comes into engagement with the engagement part 74, the lever 73 is swung to cause the swinging part 71 to swing. In this way, the toner 55 is stirred.

In addition to the swinging motion, described in the third embodiment, in response to acceleration and deceleration of the carriage 32, the swinging part 71 of the fourth embodiment undergoes an additional swinging motion effected by the lever 73. This arrangement is especially effective when the toner density is high in the toner cartridge $58_D$.

Figure 13:
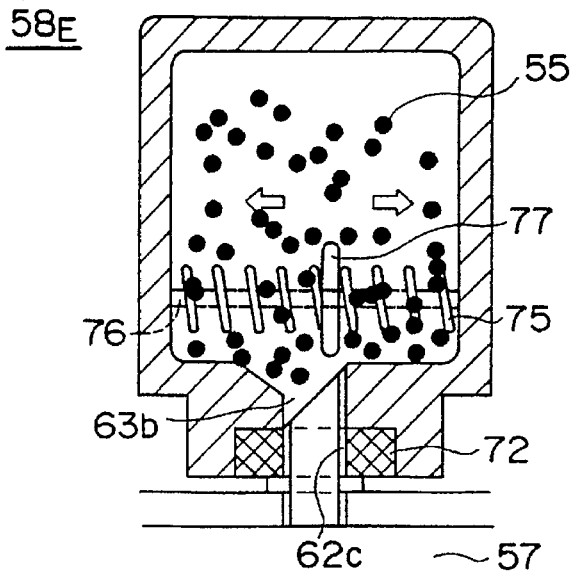
FIG. 13 is a cross-sectional view showing a constitution of a fifth embodiment of the present invention.

FIG. 13 is a cross-sectional view showing a constitution of a fifth embodiment of the present invention. FIG. 13 is a cross-sectional view of a toner cartridge $58_E$. A guide rod 76 having a coil spring 75 wound around it is provided to bridge the cavity in the toner cartridge $58_E$ in the neighborhood of the supply outlet 63*b*. A weight 77 slidable along the guide rod 76 is fitted in the coil spring 75. The guide rod 76, the coil spring 75 and the weight 77 constitute third stirring means.

The weight 77 behaves in the same way as the swinging part 71 of FIGS. 10A–10I. That is, the weight 77 swings right and left as indicated by arrows of FIG. 13 in response to acceleration and deceleration of the carriage 32, thus stirring the toner 55.

Figure 14:
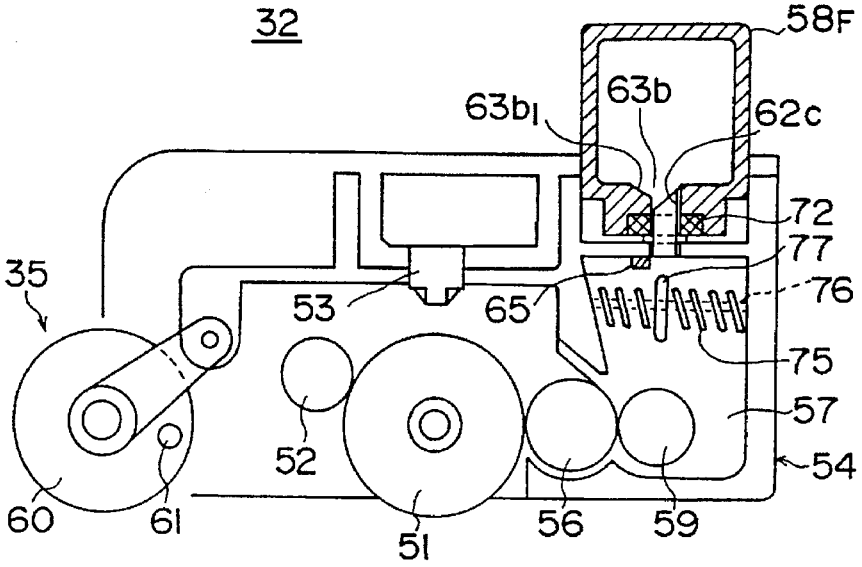
FIG. 14 is a cross-sectional view showing a constitution of a sixth embodiment of the present invention.

FIG. 14 is a cross-sectional view showing a constitution of a sixth embodiment. In the carriage 32 shown in FIG. 14, the swinging part 71 (fourth stirring means) of the third embodiment is provided in the toner chamber 57 instead of in a toner cartridge $58_F$. The other aspects of the sixth embodiment remain the same as those of the third embodiment. The swinging part 71 of the sixth embodiment swings as shown in FIGS. 10A–10I in response to a reciprocating motion of the carriage 32 so as to stir the toner 55. In this case, the toner 55 in the toner cartridge $58_F$ is supplied to the toner chamber 57 by a swinging motion of the swinging part 71 in response to the translation of the carriage 32.

By using the toner cartridge $58_F$, the supply of the toner becomes facilitated and the amount of the toner 55 in the toner chamber 57 can be maintained at the same level. The swinging part 71 stabilizes the supply of the toner to the developing roller 56, thereby improving printing quality.

Figure 15:
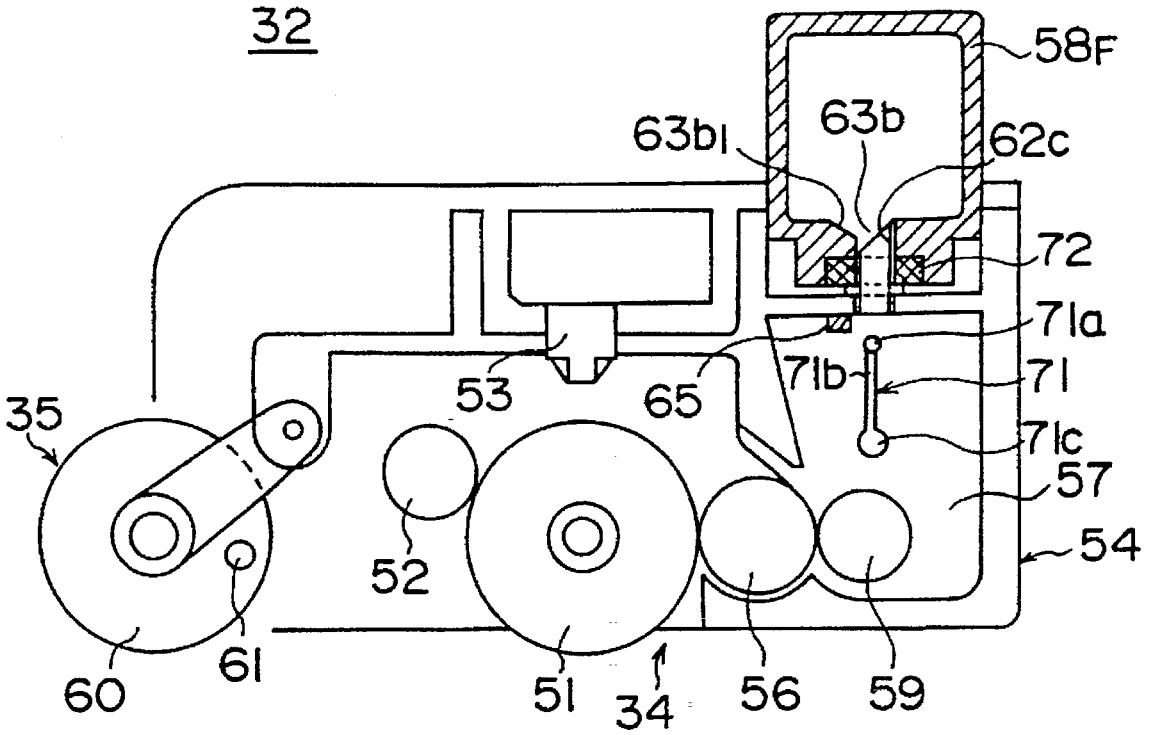
FIG. 15 is a cross-sectional view showing a constitution of a seventh embodiment of the present invention.

FIG. 15 is a cross-sectional view showing a constitution of a seventh embodiment of the present invention. In the carriage 32 shown in FIG. 15, fifth stirring means composed of the coil spring 75, the guide rod 76 and the weight 77 is provided in the toner chamber 57 instead of in the toner cartridge $58_F$.

Similarly to the fifth embodiment, the reciprocating motion of the carriage 32 causes the weight 77 to swing right and left so as to stir the toner 55 in the toner chamber 57. In this case, the toner 55 in the toner cartridge $58_F$ is supplied to the toner chamber 57 by a swinging motion of the swinging part 71 in response to the translation of the carriage 32.

By using the toner cartridge $58_F$, the supply of the toner becomes facilitated and the amount of the toner 55 in the toner chamber 57 can be maintained at the same level. The weight 77 stabilizes the supply of the toner 55 to the developing roller 56, thereby improving printing quality.

The present invention is not limited to the above-described embodiments, and variations and modifications may be made without departing from the scope of the present invention.

What is claimed is:

1. A serial electrophotographic apparatus comprising:

transporting means for transporting recording paper;

a carriage equipped, at least, with processing means for exposing a rotated image carrying body, forming a latent image by charging the image carrying body, and developing the latent image to produce a visible image by supplying a print substance from a developing part to the image carrying body, said processing means including a first supply chamber for supplying said print substance to said developing part and a second supply chamber detachably coupled to said first supply chamber;

transferring means which, provided in such a position that said recording paper is led through a space between said carriage and the transferring means, transfers said visible image onto the recording paper as said carriage is being translated;

translating means for translating said carriage over said transferring means, in a direction perpendicular to a direction in which said recording paper is transported; and a detection means for indicating when the second supply chamber should be exchanged;

wherein said second supply chamber is provided with stirring means which, swung in response to translation of said carriage, stirs said print substance in said second supply chamber.

2. The serial electrophotographic apparatus as claimed in claim 1, wherein operating means for swinging said stirring means is provided outside said second supply chamber, and engagement means which, engaged with said operating means, swings said operating means is provided at a predetermined position along a path of said carriage.

3. A serial electrophotographic apparatus comprising:

transporting means for transporting recording paper;

a carriage equipped, at least, with processing means for exposing a rotated image carrying body, forming a latent image by charging the image carrying body, and developing the latent image to produce a visible image by supplying a print substance from a developing part to the image carrying body, said processing means including a first supply chamber for supplying said print substance to said developing part and a second supply chamber detachably coupled to said first supply chamber;

transferring means which, provided in such a position that said recording paper is led through a space between said carriage and the transferring means, transfers said visible image onto the recording paper as said carriage is being translated;

translating means for translating said carriage over said transferring means, in a direction perpendicular to a direction in which said recording paper is transported; and a detection means for indicating when the second supply chamber should be exchanged;

wherein said second supply chamber is provided with stirring means for stirring said print substance in said second supply chamber by swinging in response to translation of said carriage in a direction in which said carriage is translated.

4. A serial electrophotographic apparatus comprising:

transporting means for transporting recording paper;

a carriage equipped, at least, with processing means for exposing a rotated image carrying body, forming a latent image by charging the image carrying body, and developing the latent image to produce a visible image by supplying a print substance from a developing part to the image carrying body, said processing means including a first supply chamber for supplying said print substance to said developing part and a second supply chamber detachably coupled to said first supply chamber;

transferring means which, provided in such a position that said recording paper is led through a space between said carriage and the transferring means, transfers said visible image onto the recording paper as said carriage is being translated;

translating means for translating said carriage over said transferring means, in a direction perpendicular to a direction in which said recording paper is transported; and a detection means for indicating when the second supply chamber should be exchanged;

wherein said first supply chamber is provided with stirring means which stirs, in response to translation of said carriage, said print substance in said first supply chamber by swinging in response to translation of said carriage.

5. A serial electrophotographic apparatus comprising:

transporting means for transporting recording paper;

a carriage equipped, at least, with processing means for exposing a rotated image carrying body, forming a latent image by charging the image carrying body, and developing the latent image to produce a visible image by supplying a print substance from a developing part to the image carrying body, said processing means including a first supply chamber for supplying said print substance to said developing part and a second supply chamber detachably coupled to said first supply chamber;

transferring means which, provided in such a position that said recording paper is led through a space between said carriage and the transferring means, transfers said visible image onto the recording paper as said carriage is being translated;

translating means for translating said carriage over said transferring means, in a direction perpendicular to a direction in which said recording paper is transported; and a detection means for indicating when the second supply chamber should be exchanged;

wherein said first supply chamber is provided with stirring means for stirring said print substance in said first supply chamber by swinging in response to translation of said carriage in a direction in which said carriage is translated.

6. A serial electrophotographic apparatus comprising:

transporting means for transporting recording paper;

a carriage equipped, at least, with processing means for exposing a rotated image carrying body, forming a latent image by charging the image carrying body, and developing the latent image to produce a visible image by supplying a print substance from a developing part to the image carrying body, said processing means including a first supply chamber for supplying said print substance to said developing part and a second supply chamber detachably coupled to said first supply chamber;

transferring means which, provided in such a position that said recording paper is led through a space between said carriage and the transferring means, transfers said visible image onto the recording paper as said carriage is being translated; and translating means for translating said carriage over said transferring means, in a direction perpendicular to a direction in which said recording paper is transported;

wherein a shield part having a restitutive capability is provided at an outlet of said second supply chamber via which outlet said print substance is supplied to said first supply chamber, so as to open and to seal by closing said outlet, and wherein an inserted part is provided in said first supply chamber and allowed to enter said second supply chamber through said shield part so as to establish communication between said first supply chamber and said second supply chamber.

7. The serial electrophotographic apparatus as claimed in claim 6, wherein a notch for allowing said inserted part to enter said second chamber is formed in said shield part.

* * * * *